US006997363B1

(12) United States Patent
Vossen

(10) Patent No.: US 6,997,363 B1
(45) Date of Patent: Feb. 14, 2006

(54) DEVICE FOR REMOVING BREAK-OFF COMPONENTS FROM A SHEET OF MATERIAL OR EQUIVALENT

(76) Inventor: Franz Vossen, Steisslinger Strasse 46, 78333 Stockach (DE)

( * ) Notice: Subject to any disclaimer, the term of this patent is extended or adjusted under 35 U.S.C. 154(b) by 0 days.

(21) Appl. No.: 09/647,699

(22) PCT Filed: Apr. 1, 1999

(86) PCT No.: PCT/EP99/02266

§ 371 (c)(1),
(2), (4) Date: Sep. 29, 2000

(87) PCT Pub. No.: WO99/51405

PCT Pub. Date: Oct. 14, 1999

(30) Foreign Application Priority Data

| | | |
|---|---|---|
| Apr. 2, 1998 | (DE) | 198 14 736 |
| May 8, 1998 | (DE) | 198 20 557 |
| Aug. 18, 1998 | (DE) | 198 37 316 |
| Aug. 21, 1998 | (DE) | 298 15 042 U |

(51) Int. Cl.
*B26F 3/00* (2006.01)
*B26D 7/18* (2006.01)

(52) U.S. Cl. ..... 225/93; 225/97; 225/103

(58) Field of Classification Search ..... 225/93, 225/97, 103, 104, 96.5; 83/109, 111, 162, 83/165, 118, 119
See application file for complete search history.

(56) References Cited

U.S. PATENT DOCUMENTS

| | | | | |
|---|---|---|---|---|
| 3,303,979 A | * | 2/1967 | Lang | 225/103 |
| 3,552,615 A | * | 1/1971 | Murray | 225/97 |
| 3,784,070 A | * | 1/1974 | Vossen | 225/97 |
| 3,889,563 A | * | 6/1975 | Westermann | 83/165 |
| 4,015,495 A | * | 4/1977 | Yerly | 225/97 |
| 4,033,240 A | | 7/1977 | Deslauriers | |
| 4,367,069 A | * | 1/1983 | Bishop | 225/97 |
| 4,821,615 A | * | 4/1989 | Bakermans et al. | 83/147 |
| 4,836,071 A | * | 6/1989 | Ersoy | 83/140 |
| 4,985,012 A | | 1/1991 | Marschke | |
| 5,065,926 A | | 11/1991 | Yerly | |
| 5,179,882 A | * | 1/1993 | Takeuchi et al. | 83/125 |
| 5,181,640 A | | 1/1993 | Vossen et al. | |
| 5,735,442 A | * | 4/1998 | Emrich | 225/103 |

(Continued)

FOREIGN PATENT DOCUMENTS

| | | |
|---|---|---|
| DE | 41 03 339 | 9/1992 |

(Continued)

OTHER PUBLICATIONS

Patent Abstracts of Japan, Japanese Publication No. 08294898, published Nov. 12, 1996.

(Continued)

*Primary Examiner*—Stephen Choi
(74) *Attorney, Agent, or Firm*—Bachman & LaPointe, P.C.

(57) ABSTRACT

The invention relates to a device for removing break-off pieces (12), especially waste parts, from a sheet of material containing blanks or similar flat pieces. An abutment device (20) which can move in a longitudinal direction is associated with a break-off tool (40, 42). The abutment device protrudes into a through opening (16). Even when said device is in a rest position it supports the break-off component or waste part of the sheet of material (10) in an approximately parallel position. When the waste part moves, its position can be modified by the break-off tool and brought into a specific angle of inclination in relation to the sheet of material, especially when the waste part is lowered.

19 Claims, 7 Drawing Sheets

U.S. PATENT DOCUMENTS 5,896,795 A * 4/1999 Harhay et al. ..... 83/111
6,102,268 A * 8/2000 Raveleau ..... 225/97

FOREIGN PATENT DOCUMENTS

EP 0 641 632 3/1995
GB 2 300 377 11/1996
WO WO 97/30829 8/1997

OTHER PUBLICATIONS

Patent Abstracts of Japan, Japanese Publication No. 07132497, published May 23, 1995.

* cited by examiner 10
12
14
16
17
18
20
22
24
25
26
27
30
32
34
35
36
38
40/42
44
a
b
d
h
x

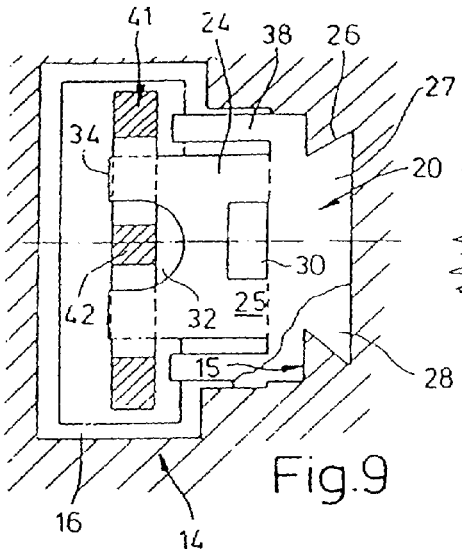
Fig.9
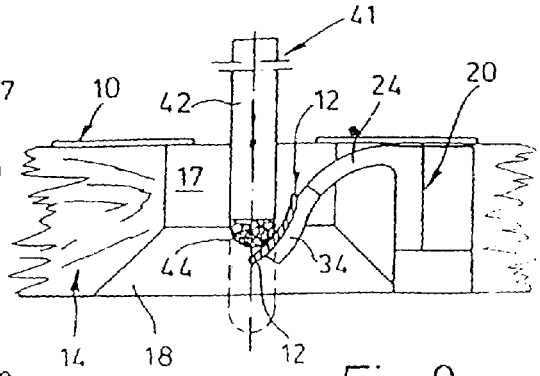
Fig.8
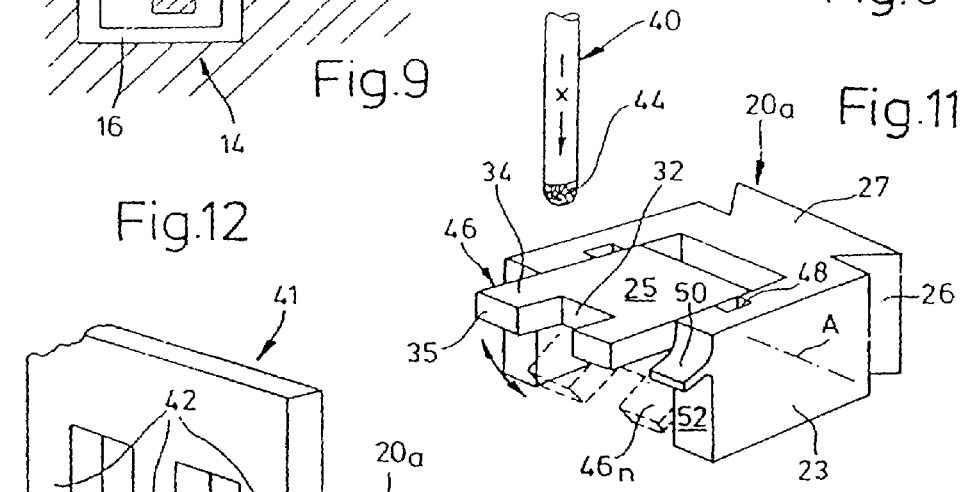
Fig.11
Fig.12
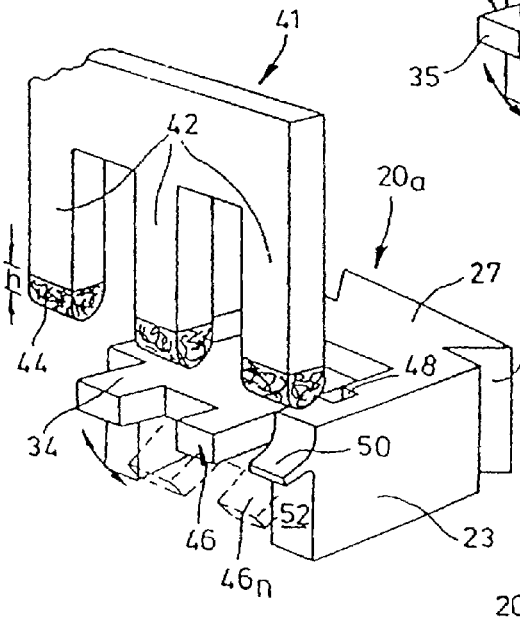
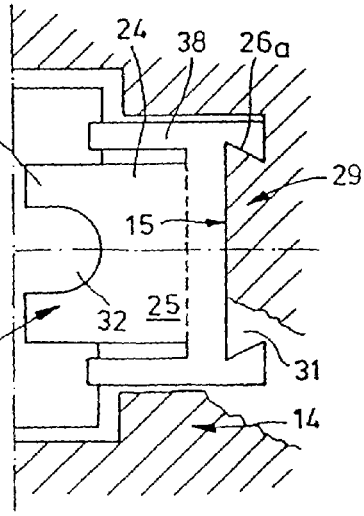
Fig.10

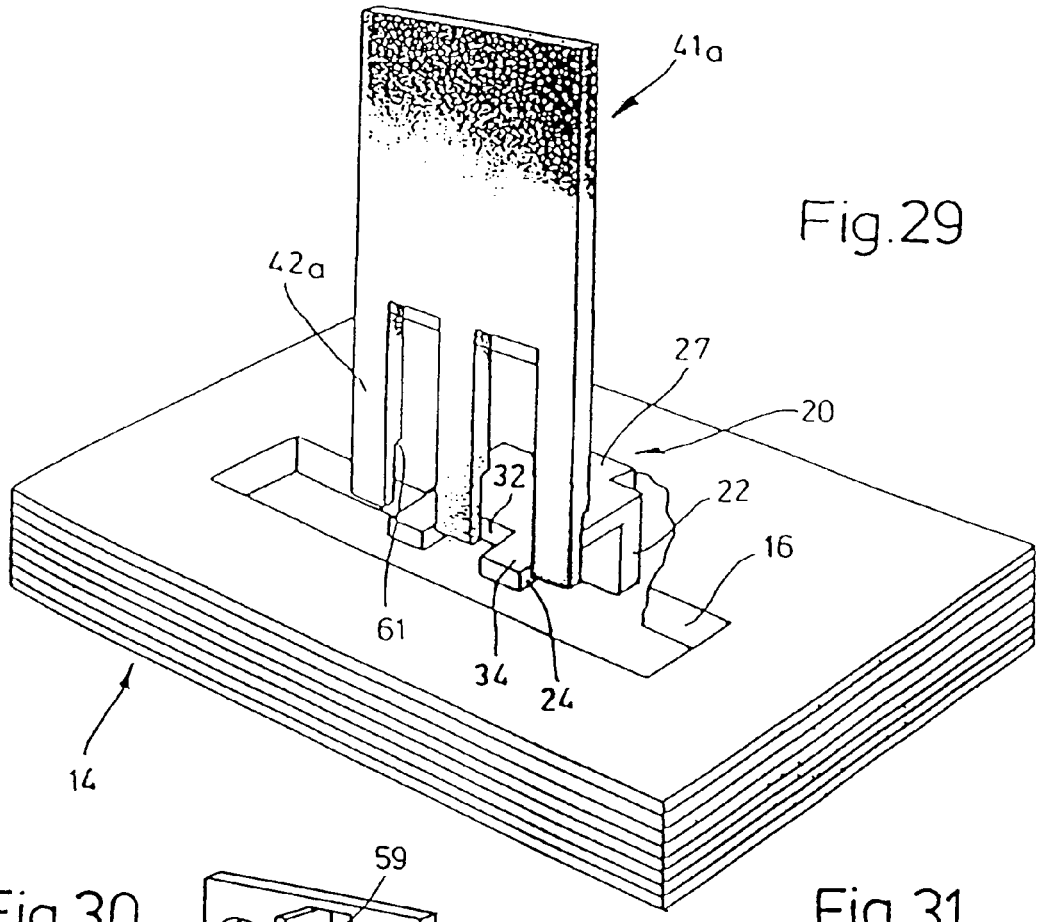
Fig.29
Fig.30
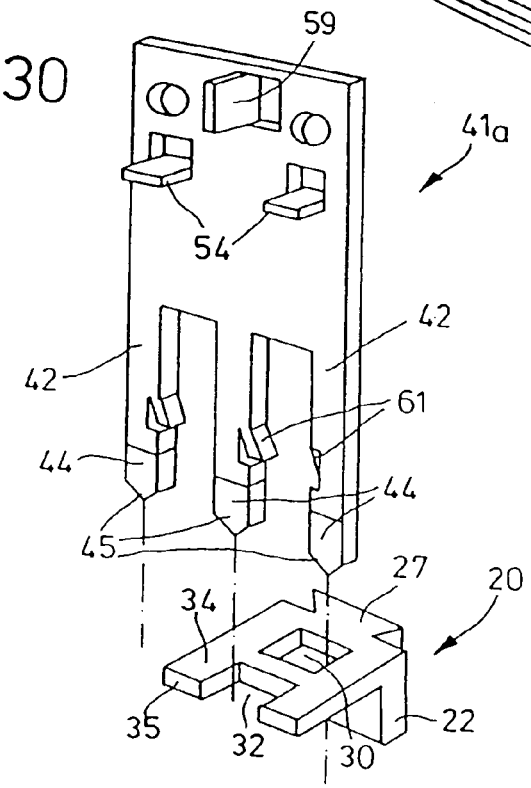
Fig.31
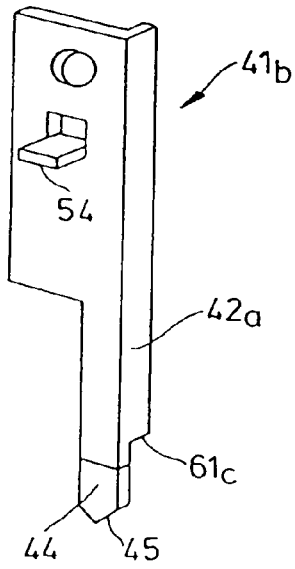

Fig.41
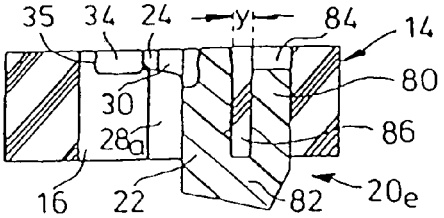
Fig.43
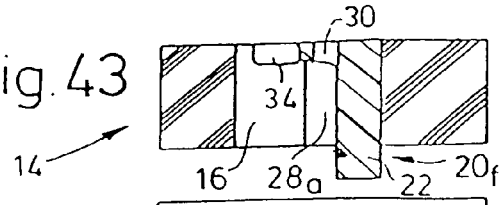
Fig.44
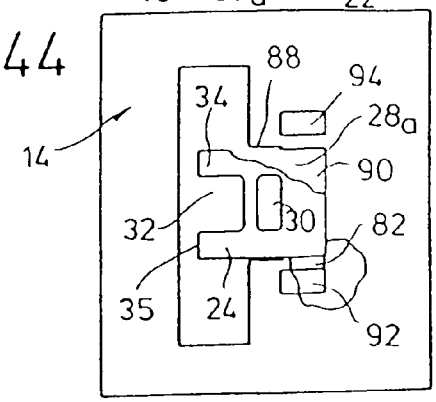
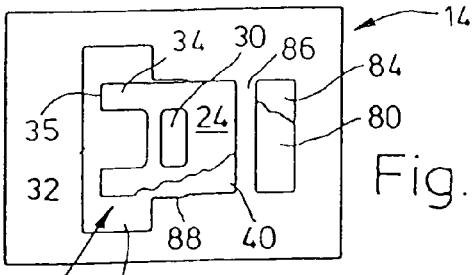
Fig.42
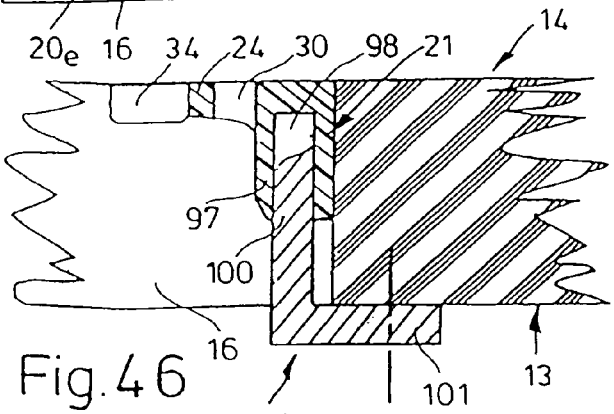
Fig.46
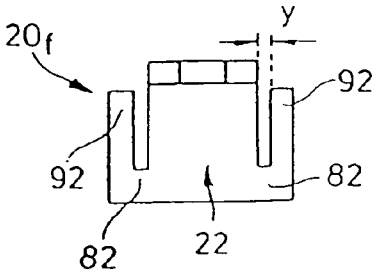
Fig.45
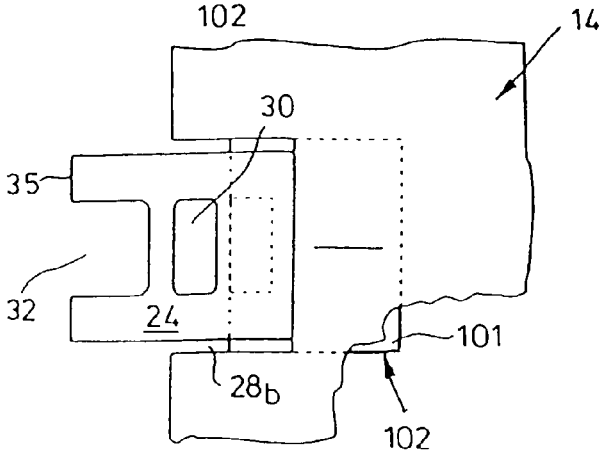
Fig.47
Fig.48
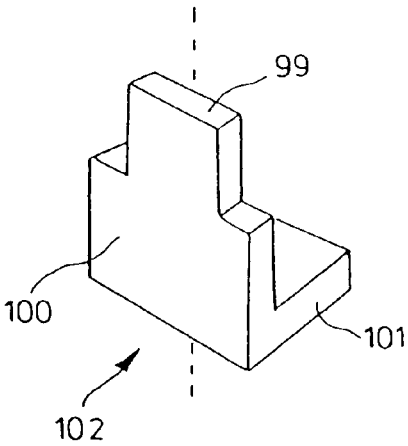

DEVICE FOR REMOVING BREAK-OFF COMPONENTS FROM A SHEET OF MATERIAL OR EQUIVALENT

BACKGROUND OF THE INVENTION

The invention concerns an apparatus for removing broken-out pieces, in particular waste potions, from a sheet of material containing blanks or the like flat portions, as set forth in the classifying portion of the independent claim.

EP 0 446 702 B1 to the present applicant discloses that automatic stamping machines for the production of blanks from sheets of card in the folding box industry have been provided for more than 30 years with breaking-out devices which are preferably arranged in a setting-up table outside the stamping machine. Such a breaking-out station is of particular importance in terms of manufacture as in the event of incorrect use it involves the highest proportion of the total setting-up time and a poorly set breaking-out station results in continual disturbances in the production procedure.

In the breaking-out station the stamped cardboard sheet, after reaching a predetermined detent position, on the breaking-out surface which is usually provided by a breaking-out board or a female die, is freed of the waste by means of breaking-out pins or cutting edges which press from above.

Development in the breaking-out procedures involved firstly entailed the top tool pin which presses downwardly from above and which passes the waste portion through the opening in the breaking-out board. There was then added an additional bottom tool with bottom pins, which are aligned with the top tool pins and which clampingly hold the waste portion. As a breaking-out tool can reliably break out a waste portion only when there is a certain force-locking engagement between the tool and the waste portion, the above-mentioned bottom pins have proven to be an advantageous resistance at the moment when the breaking-out tool or breaking-out member comes to bear against the waste portion.

If there is a wish to avoid using a clamping tool, the breaking-out opening in the breaking-out surface must be smaller at various locations, than the waste portion which is associated therewith, so that the waste portion rests with a relatively high friction, in small surface areas, on the breaking-out surface or female die. When the breaking-out pin comes into contact with the waste portion, the above-mentioned resistance occurs by virtue of the friction which is then produced. When the breaking-out pin and the waste portion pass through the opening, friction occurs at the relatively close walls of the hole, whereby a certain force-locking action is achieved.

DE-A-25 35 452 discloses the so-called DYN-pin, namely a breaking-out pin having a tip or point whose substantially conical side walls are of contours which are concave in cross-section, with a smooth surface. In the breaking-out procedure, that tip bears against the waste portion which, by virtue of being supported on the edges of the opening, opposes the tip with such a level of resistance that the tip can penetrate slightly into the material of the waste portion. That prevents unwanted lateral deflection movement of the waste portion. As it passes through the opening, the waste portion bends, and the stressing force between it and the wall of the opening is intended to afford the DYN-pin sufficient friction for the desired force-locking engagement with the waste portion; that could then possibly make a bottom tool in itself unnecessary, when using the DYN-pin.

As a simplification for breaking-out tools, above-mentioned EP 0 446 702 B1 proposes a support means which is a surface which is movable and/or resilient within the opening—at least in part in an inclined position —at a spacing relative to the breaking-out surface and which, in its rest position, engages substantially parallel beneath the waste portion in the sheet of material and which, upon movement—that is to say primarily upon downward movement—of the waste portion, is transferred, by the breaking-out member, into an angle of inclination with respect to the sheet of material. The resilient surface can be in the form of a tongue-like spring which is fixed at one end to the breaking-out surface—substantially aligned therewith in the rest position—while the free end of the tongue-like spring is arranged in the opening. Also described are angle portions having one limb aligned with the breaking-out surface while the other limb thereof is pivotably mounted beneath the breaking-out surface and is subjected to a spring loading. The resilient surface can also be afforded by rubber profile members or by bristles.

Finally, DE-C-41 24 089 provides a cuboidal breaking-out tool of rectangular cross-section, from the pressing end of which two pressing tips or points project, in line with the two narrow sides thereof.

SUMMARY OF THE INVENTION

In consideration of that state of the art relating to the breaking-out procedure, the inventor set himself the aim of substantially improving the removal of waste portions from sheets of material and simplifying the tools required for that purpose. In particular the invention seeks to provide that those tools can be used for the treatment of very small waste pieces.

That object is attained by the teaching of the independent claim; the appendant claims set forth advantageous developments. In addition the scope of the invention embraces all combinations of at least two of the features disclosed in the description, the drawings and/or the claims.

In accordance with the invention, the support means is formed by a support tool which is rigidly connected in positively locking relationship to the breaking-out surface or female die in the edge region of the opening, and is provided with a contact or support surface which can be inclined with respect to that connection pairing.

In a preferred embodiment this connection pairing comprises a vertical receiving groove—extending in the breaking-out direction—in the female die at the edge of the opening thereof on the one hand and a coupling bar or rib which can be fitted thereinto, on the other hand. In a further preferred embodiment the support tool has an undercut groove for receiving a corresponding coupling bar of the female die.

The respective cross-sections of the coupling bar and the receiving groove should advantageously be of a dovetail-shaped configuration and thus define an operative position which is easy to bring about. It is perhaps possible to provide a plurality of such connecting pairings.

In accordance with a further feature of the invention the support tool is an angle portion with at least one coupling rib of dovetail-shaped cross-section which is formed out of the one limb—being vertical in the position of installation—, and another flexible limb which forms the support surface—being horizontal in the position of installation. In that respect, it has proven to be desirable for the angle portion generally to be formed from a material of limited flexibility, which ensures a long service life.

In a preferred embodiment the connection pairing comprises at least one vertical receiving groove—extending in the breaking-out direction—in the female die at the edge of the opening thereof on the one hand, and a portion—which can be fitted thereinto—of a vertical limb of the support tool on the other hand. The respective cross-sections of the coupling bar and the opening are advantageously to be of a rectangular configuration and thus define an operative position which is easy to bring about. A plurality of such connection pairings can possibly be provided.

It has proven to be desirable if the flexible limb forming the support surface has an edge opening which is delimited at both sides by cantilever portions, and, at a spacing relative to the edge opening, at least one inner opening. That configuration affords a particularly desirable support surface which is stable in respect of shape and nonetheless flexible.

It is also in accordance with the invention that formed on the vertical limb is at least one pin-like plug-in element which extends or extend at a spacing relative to the vertical limb and which is respectively adapted to be inserted into an opening provided in the female die at a spacing relative to the receiving groove. Like also the opening which receives the plug-in element, the plug-in element is to be of a rectangular cross-section, while the plug-in element projects either at a spacing relative to the back surface of the vertical limb or at a spacing relative to the flank surface of the vertical limb, from a respective transverse web portion. In the structure involving association with the flank surfaces, a pair of plug-in elements is preferred.

In a particular embodiment the flank surfaces of the vertical groove are stepped, wherein the vertical limb is supported in the back region, which is narrower in cross-section, of that stepped vertical groove, and therefore the horizontal limb projects beyond the wider front region of the vertical groove.

In another embodiment the vertical limb is to be connected with a coupling pairing to a limb, which extends in the vertical groove, of an angle bracket whose other limb is connected to the female die, preferably by means of force-locking engagement. It is however also possible to provide a pocket at the underside of the female die, for the limb of the angle bracket, whereby that limb projects in positively locking engagement into same.

So that the broken-out piece is possibly held after the releasing procedure, at least one catch finger can be arranged downstream, in the breaking-out direction, of the limb forming the support surface; a pair of catch fingers which are in flanking relationship on both sides is however preferred. The catch fingers increase in width from their free end towards the limb formed thereon, in terms of longitudinal section, for the purposes of increasing the degree of flexibility thereof. In another embodiment the horizontal limb is flanked by side portions which are formed on the other limb, and therefore extend vertically.

Another embodiment provides a support tool with a partial frame which is approximately U-shaped in cross-section and which comprises a back portion having the coupling rib and having two parallel side walls; a support plate for the broken-out portion is arranged between said side walls, pivotably about an axis which is generally horizontal in the position of use.

The feature whereby the breaking-out tools extend between surfaces of the support means, said surfaces being movable in the breaking-out direction, results in a higher level of operational reliability as the arrangement affords a kind of tongs or pincer engagement; that cannot be achieved in the state of the art as the breaking-out tools are usually within the contour which is defined by the free edges of the surfaces.

Engagement of the breaking-out tools can also become more efficient when an edge opening is disposed in opposite relationship to the free end of the tools, the edge opening extending from the free edge of the support surface.

It has proven to be desirable to associate with the support surface, as a breaking-out tool, a pressure pin having a rounded free end or a fork member with one or more finger-like fork prongs, preferably of flat cross-section.

In particular small waste pieces also take part in the bending movement of the breaking-out tool, in such a way that they assume a perpendicular position. When dealing with smooth cardboard surfaces, that results in slipping movement of the pressure pins on the surface of the cardboard and thus results in the waste portions being unsatisfactorily broken away. Therefore, for the sake of better engagement, the free end of the pressure pin or the fork prongs is in the form of a rough surface. That rough surface can be formed by a coating which for example is formed with oxides, carbides, corundum or the like and is possibly applied by means of thermal spraying. Another embodiment according to the invention provides a rough surface with irregularities such as teeth or steps in the surface of the pressure pin or the fork prong or prongs. The irregularities can be produced by a mechanical, chemical or electrical treatment.

By virtue of the rough surface described—for which protection is claimed separately—the arrangement affords the desired firm engagement and the piece which is to be broken away is effectively prevented from sliding away. For that purpose, it has been found sufficient for the axial height of the rough surface to correspond at most to the diameter of the pressure pin or the width of the fork prong, preferably making it less than 5 mm.

Each fork member is to project from a plate-shaped male die and in accordance with the invention it is connected thereto by a portion of the fork member which has clamping noses and which can also have abutments which are guided against the underneath surface of the male die.

Other insert portions for the female die are shaped support portions which are arranged in the opening of the female die at the edge thereof and which are fitted to plug-in profile members and which are disposed in mutually opposite relationship and which are provided with mutually directed radial support lips of elastic material. Preferably that shaped support portion is an angle portion of which one limb is the support lip, while the other limb formed thereon is formed by a hollow profile member; the latter preferably corresponds to a cylindrical cup and is pressed on to a plug-in profile member by a simple assembly procedure in the breaking-out direction.

The scope of the invention also embraces clip-like tools which are fixed at the opening in the female die and which each include a respective frame portion from which resilient support tongues project inwardly or on which are arranged inwardly disposed support plates which can be guided about a pivot axis; that arrangement therefore affords simple additional tools in the form of spring clips or mechanically moved clips which would even permit standardisation of the tools.

BRIEF DESCRIPTION OF THE DRAWINGS

Further advantages, features and details of the invention will be apparent from the description hereinafter of preferred embodiments and with reference to the drawings in which:

FIG. 8 is a view on an enlarged scale approximately corresponding to FIG. 6, with a support tool which is modified in relation to FIG. 6, and another breaking-out tool, FIG. 9 is a plan view of a part of a further breaking-out board with support tool and breaking-out tool as shown in FIG. 8, FIG. 10 is a view corresponding to FIG. 9 of a further embodiment, FIG. 11 is a perspective view of a further support tool with breaking-out tool and the indicated end positions of a movable support plate, FIG. 12 is a view corresponding to FIG. 11 of an arrangement with a breaking-out tool, FIG. 31 shows a perspective view of another breaking-out tool, FIGS. 41, 43 and 46 show sectional views of breaking-out boards with respectively inserted support tools, FIGS. 42, 44 and 45 show plan views of the structures shown in FIGS. 41, 43 and 46, FIG. 47 is a front view of the support tool of FIGS. 43 and 44, and FIG. 48 is a perspective view of the support tool of FIGS. 46 and 47.

DESCRIPTION OF PREFERRED EMBODIMENTS

Figures 1, 2, 3, 4, 5, 6, 7:
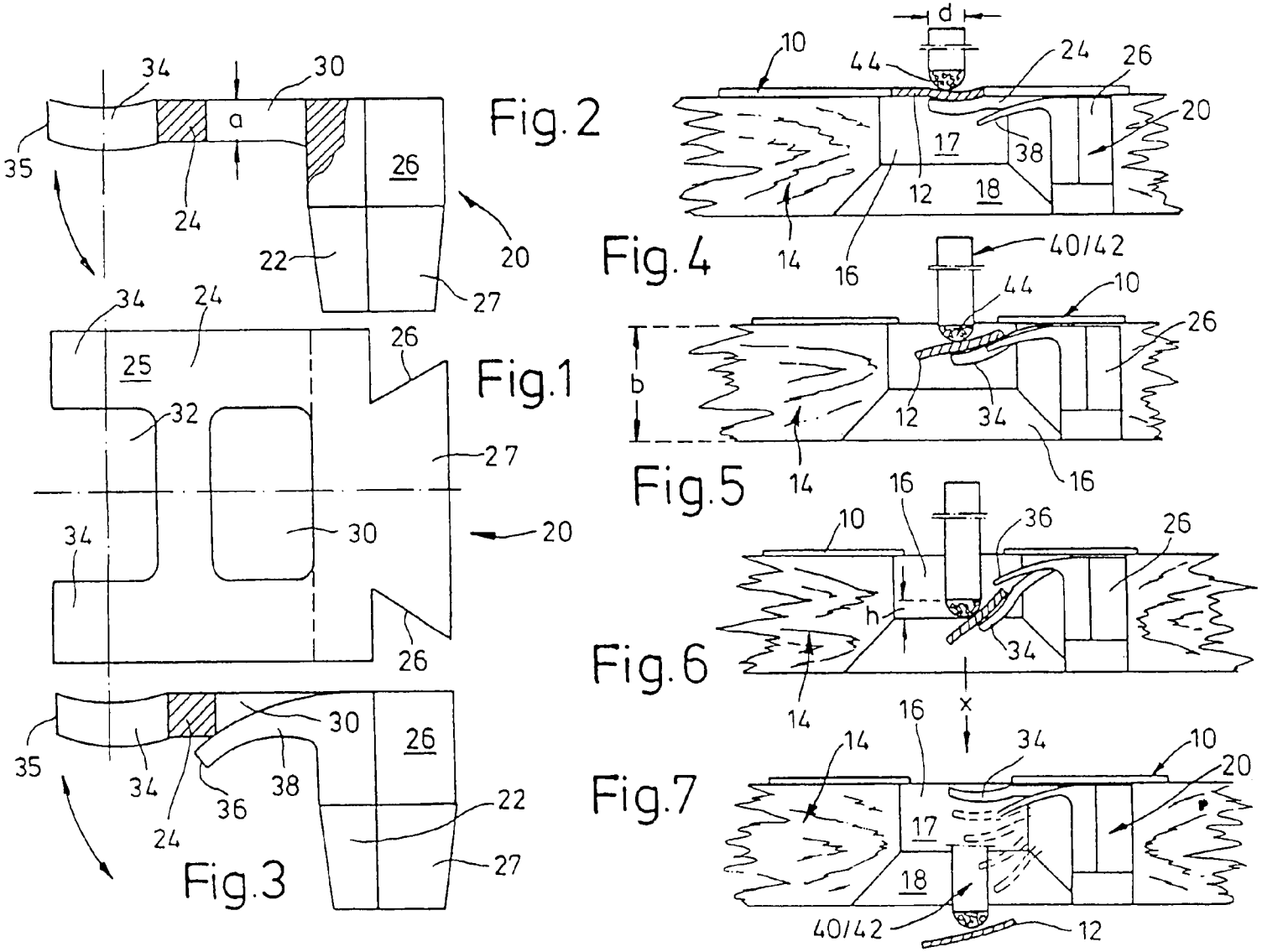
FIG. 1 is a plan view of a support tool for a waste portion for the removal thereof from cardboard sheets in the corrugated cardboard and folding box industry.
FIG. 2 is a side view of FIG. 1.
FIG. 3 is a side view corresponding to FIG. 2 of another embodiment.
FIGS. 4 through 7 are diagrammatically illustrated successive method steps with a breaking-out board which is shown in section and which includes a support tool as shown in FIGS. 1 and 3 and with which a breaking-out tool is associated.

Cardboard sheets 10 which are used in the folding box industry have stamped blanks for folding boxes or the like, with waste portions 12 being produced in or on the blanks. Downstream of a stamping station which is not shown in the drawing for reasons of enhanced clarity thereof, the stamped cardboard sheet 10 passes on to a breaking-out board or a female die 14 of a thickness b for example of 12 mm, on which the sheet 10 is freed of its waste portions 12; the waste portions 12 are disposed over openings 16 which are of a configuration designed in dependence on the contour of the waste portions 12 and at which, in the cross-sectional view in FIGS. 4 through 7, an upper frame portion 17 with a vertical wall is followed by a downwardly opening conical portion 18.

Fixed in the opening 16 is a support tool 20 for the waste portion 12, which as shown in FIGS. 1 and 2 is a kind of angle portion having two limbs 22 and 24 of flexible plastic material with a high level of endurance in relation to fluctuating loadings thereon. Projecting from the limb 22 which extends vertically in the position of installation is a coupling rib 27 which has flanks 26 of an undercut configuration and which is inserted into a vertical groove 28 of dovetail-shaped cross-section in the female die 14. As FIG. 9 clearly shows the vertical groove 28 extends from a wall surface 15 defining the opening 16.

The resilient horizontal limb 24 of the support tool 20, of a thickness a, has an inner opening 30 and at its free edge 25 an edge opening or recess 32; two prong-like cantilever portions 34 of the horizontal limb 24, which flank the edge opening 32, are curved in longitudinal section and each form a kind of bowl or cup.

In the embodiment shown in FIG. 3, formed on the vertical limb 22 is a catch finger 38 for the waste portion 12. The catch finger 38 is curved downwardly in its longitudinal section and narrows towards its free end 36.

The waste portion 12 which rests on the surface 25 of the horizontal limb 24 is subjected to a pressure from above by a breaking-out member or tool in the form of a pressure pin 40 with a roughened part-spherical pressure end which is similar to a fingertip, with the contact between the pressure end and the waste portion being in point form or—for example in FIGS. 8 and 12—as a fork member 41, in substantially linear configuration; the flat fork prongs 42 of the fork member 41 are aligned with each other. Both the part-spherical pressure end of the pressure pin 40 and also the flat ends of the above-mentioned fork prongs 42 are provided with a coating 44, affording the roughness thereof, of an axial height h of between about 4 and 10 mm. The coating was produced for example by thermal spraying from aluminum oxide, corundum, carbide grains or the like.

The preferred height h is at most equal to the diameter d of the pressure pin 40 and the roughness depth is less than 0.5 mm. That coating can also be replaced by roughening of the surface of the pressure pin or the flat prong 41, which is effected chemically, electrically or—for example by means of sand blasting—mechanically.

In the downward movement of the breaking-out tool or tools 40, 41, the waste portion 12 is separated by pressure from the cardboard sheet 10 and carried away downwardly in the breaking-out direction x.

In the embodiment shown in FIG. 9 the edge opening 32 is at its end of a part-circular contour and the horizontal limb 24 is flanked by side portions which respectively form the above-described catch fingers 38 and which—like also the horizontal limb 24 itself—are formed on the vertical limb 22.

FIG. 10 indicates a connection pairing between the support tool $\mathbf{20}_n$ and the female die 14, which is modified in relation to the embodiment shown in FIG. 9; the female die 14 engages with a vertical bar 29 which projects from the wall surface 15, into a vertical groove 31 in the support tool 20 or the vertical limb 22 thereof. The flank of the vertical groove 31 is identified by reference $\mathbf{26}_a$.

In the support tool $\mathbf{20}_a$ shown in FIGS. 11 and 12, the support surface 25 for the waste portion 12 is provided by a support plate 46 which hangs separately between side walls 23; the support plate 46 rests with lateral trunnions which are not visible—pivot axis A—in finite mounting grooves 48 in the side walls 23 and can be moved from the horizontal position into the inclined position indicated at $\mathbf{46}_n$. In that position the support plate 46 is disposed in approximately parallel relationship with the inclined front ribs 50 of the side walls 23, the front ribs 50 also forming catch fingers.

Figure 13:
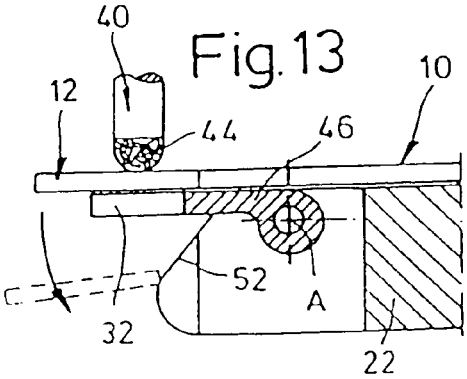
FIG. 13 is a diagrammatic view in section relating to FIGS. 11 and 12, FIGS. 14 and 15 respectively show a support tool in plan and a breaking-out tool illustrated in section.

FIG. 13 is intended to show the manner of suspending the support plate 46 forming a kind of mechanical finger, as well as forwardly and downwardly inclined front surfaces 52 of the side walls 23, as deflector means for the waste portion 12.

Figure 14:
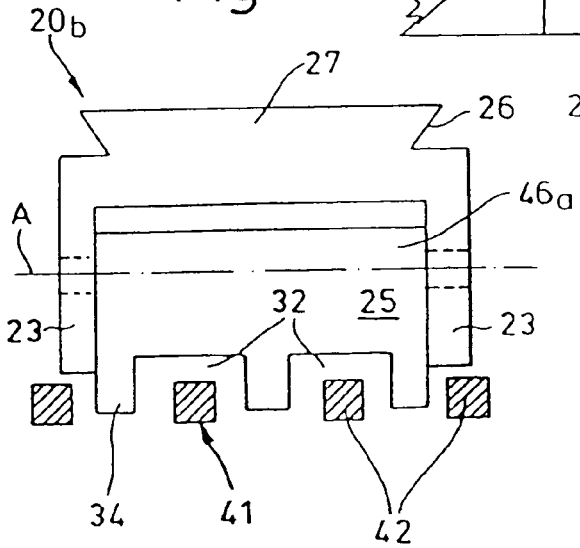

The support plate $\mathbf{46}_a$ in FIG. 14, which is intended for long waste portions 12, shows two edge openings or chambers 32, with which there are associated flat prongs 42 of a fork member 41 which is otherwise not shown herein.

Figure 15:
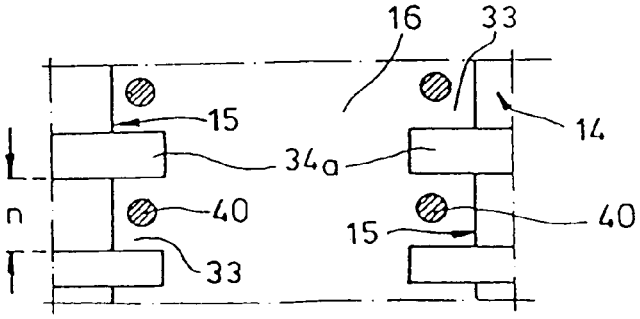

In FIG. 15, strip-like cantilever portions $\mathbf{34}_a$ of flexible material project from oppositely disposed wall surfaces 15 which define the opening 16. The cantilever portions $\mathbf{34}_a$ form between them chamber spaces 33 of a width as indicated at n; the cantilever portions $\mathbf{34}_a$ flank the pressure pins 40 which engage into the chamber spaces 33, or flat prongs 42 corresponding to the pressure pins.

Figure 16:
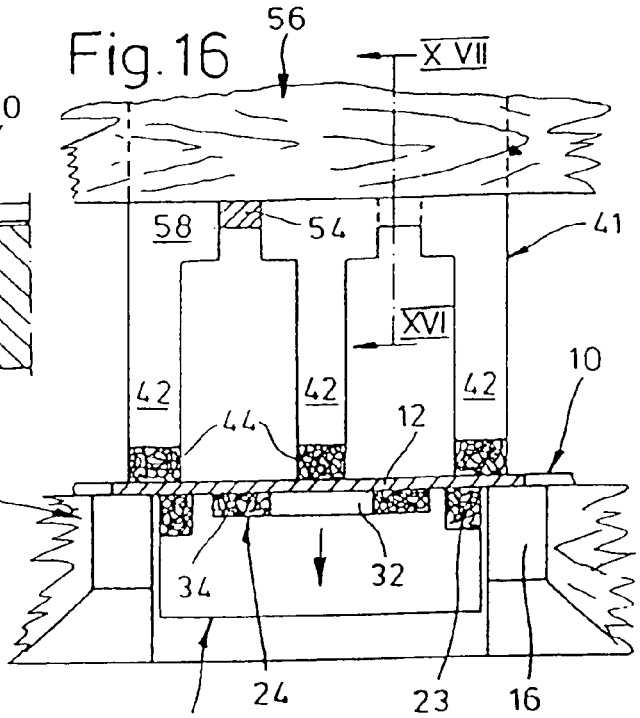
FIG. 16 is a front view in section of the arrangement shown in FIG. 9.
Figure 17:
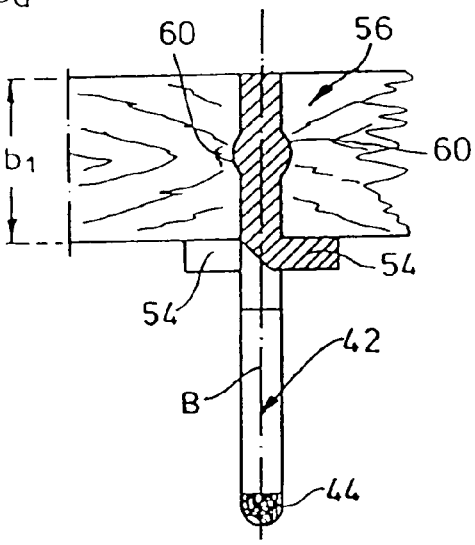
FIG. 17 shows the mounting arrangement for the breaking-out tool of FIG. 16 taken along line XVII—XVII therein.
Figures 18, 19, 20, 21, 22:
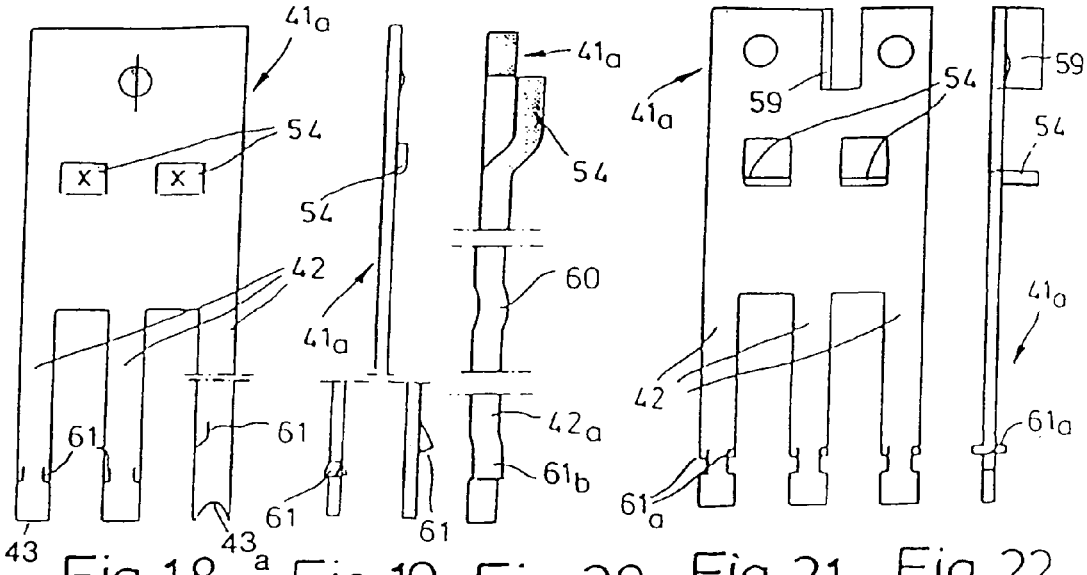
FIG. 18 is a front view of a plate-like breaking-out tool in two embodiments.
FIG. 19 shows two side views in relation to FIG. 18.
FIG. 20 is a view in section on an enlarged scale through a further embodiment of the breaking-out tool of FIG. 18.
FIG. 21 is a view corresponding to FIG. 18 of a further breaking-out tool.
FIG. 22 is a side view relating to FIG. 21.
Figures 24, 25, 26:
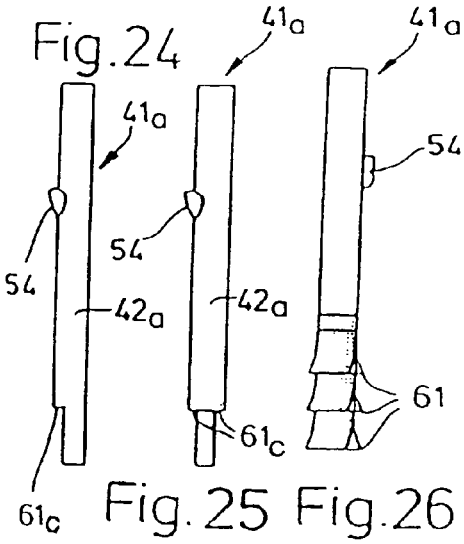
FIGS. 24 through 26 show side views of three other embodiments of the breaking-out tool.

FIGS. 16 and 17 show that the fork member 41 is firmly driven into a male die 56 of plywood of a thickness $b_1$ of for example 12 mm, as far as abutments 54 which are formed from the fork member 41 and which are directed transversely with respect to the prong axis B. The firm fit is produced by means of abutment plates 59 (FIGS. 21 through 23) which are near the upper edge and which are parallel to the prong axis B, or by means of clamping noses 60 or gripping ridges which project at both sides from the surfaces 58 of the fork member 41.

The ridge-like clamping nose 60 or the abutment 54 respectively can also be seen in the fork member $\mathbf{41}_a$ shown in FIGS. 18 through 25. The free ends of the fork prongs or flat prongs 42—the free ends being defined by straight or curved end edges 43 and $\mathbf{43}_a$ respectively—have in this case mechanically produced roughness in the form of teeth 61 which are inclined at about 30° in FIGS. 18 and 19 and which are shaped near the edge at one or both sides, teeth $\mathbf{61}_a$ which project at about 90° in FIGS. 21 and 22, hooks $\mathbf{61}_b$ (FIG. 20) or shoulders $\mathbf{61}_c$ which are formed on fork prongs $\mathbf{42}_a$.

Figure 23:
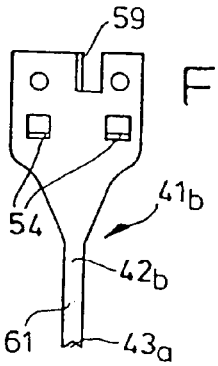
FIG. 23 is a front view of another breaking-out tool.

In addition FIG. 23 shows a breaking-out tool $\mathbf{41}_b$ with only one flat prong $\mathbf{42}_b$ which is delimited downwardly by the above-mentioned end edge $\mathbf{43}_a$ which is curved in cross-section.

Figures 27, 28:
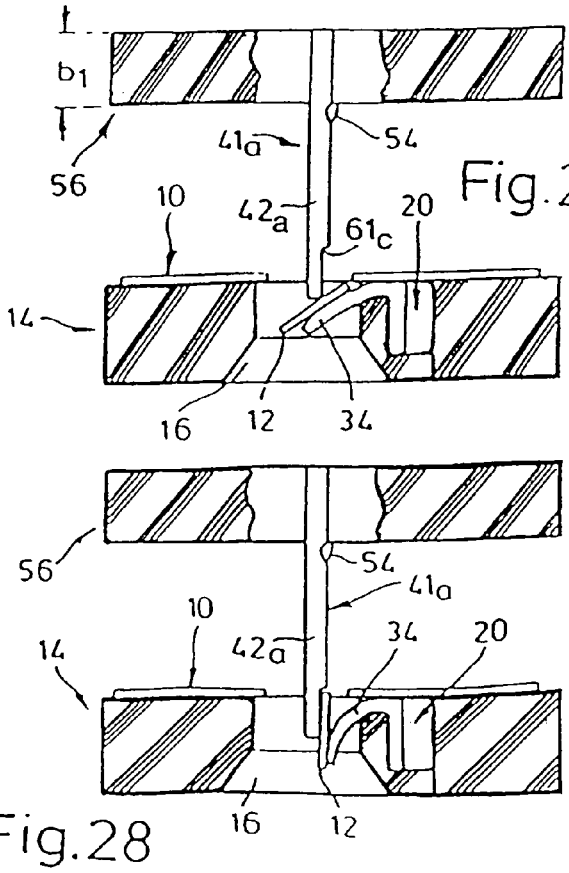
FIGS. 27 and 28 show the breaking-out tool of FIG. 24 in two stages of a breaking-out operation, FIGS. 29 and 30 respectively show a perspective view of a unit comprising a support tool and a breaking-out tool.

In that respect, FIGS. 27 and 28 clearly show how a small waste portion 12 is engaged by the free end of the flat prongs $\mathbf{42}_a$ and laid into the shoulder $\mathbf{61}_c$, for perpendicular positioning thereof. Reliable downward guidance of the waste portion 12 is ensured by virtue of the fact that it is pressed in force-locking engagement against the breaking-out tool or fork member $\mathbf{41}_a$ by the cantilever portion 34 of the support tool 20. Because the waste portion 12 is caused to bear against the breaking-out tool $\mathbf{41}_a$ in force-locking engagement therewith in that way, the shoulders 61, produce their effect. In the breaking-out process the breaking-out tool $\mathbf{41}_a$ presses the waste portion 12 against the support tool 20, clamps it in place and guides it positively downwardly. In that procedure the waste portion is disposed approximately perpendicularly. Upon further downward movement of the breaking-out tool, the waste portion 12 is pushed downwardly by the tooth 61, $\mathbf{61}_a$—or the hook $\mathbf{61}_b$ or the shoulder $\mathbf{61}_c$. The support tool 20 or the cantilever portion 34 thereof moves rapidly back into its initial position.

The described system affords advantages not only in relation to internal waste portions 12, but also in relation to so-called edge waste; the procedure for breaking away edge waste is effected only with the above-described combination of the breaking-out tool $\mathbf{41}_a$ and the support tool 20; wooden die or support members are unnecessary. The risk which arises due to wooden die or support members which are necessarily disposed close to the breaking-out female die 14 no longer arises. A spacing of 4 mm between the breaking-out tool $\mathbf{41}_a$ and the outside contour of the breaking-out female die 14 affords sufficient tolerance and security. A movement in the severing operation, which corresponds to the pitching action, carries the edge waste positively away from the breaking-out female die 14. As in the case of internal waste, in this case also the edge waste is disposed perpendicularly and is reliably guided downwardly by the thrust teeth 61, $\mathbf{61}_a$, $\mathbf{61}_b$, $\mathbf{61}_c$.

FIG. 29 shows an illustrative perspective view of a female die 14 which is made from plywood, with an angle portion 20 which serves as a support tool being releasably secured to the opening 16 thereof; disposed above the angle portion 20 is a fork member $\mathbf{41}_a$ with shoulders 61, which are formed in its flat prongs $\mathbf{42}_a$.

The fork member $\mathbf{41}_a$ in FIG. 30 shows the teeth 61 which project inclinedly from the flat prongs 42 into the intermediate spaces between the prongs, and a region of a coating 44 on the finger or end portions 45 of the flat prongs, which are shaped downwardly as pointed tips.

The breaking-out tool $\mathbf{41}_b$ in FIG. 31—corresponding to that shown in FIG. 23—is provided with a flat prong $\mathbf{42}_a$ which is here disposed laterally and which has a shoulder $\mathbf{61}_c$ at its end.

Figure 33:
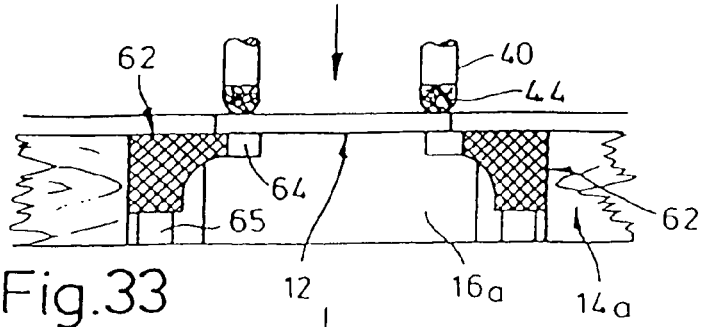
FIGS. 33 and 34 show two views corresponding to FIGS. 4 and 5 respectively of a working operation with support tools as shown in FIG. 32, FIGS. 35 through 38 show plan views of special tools having a spring action.
Figure 32:
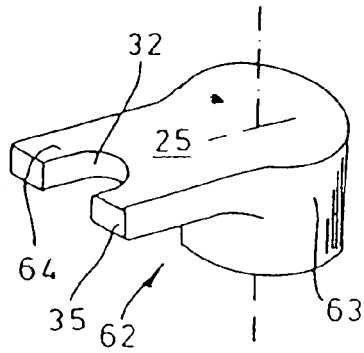
FIG. 32 shows a perspective view of another embodiment of a support tool.
Figure 34:
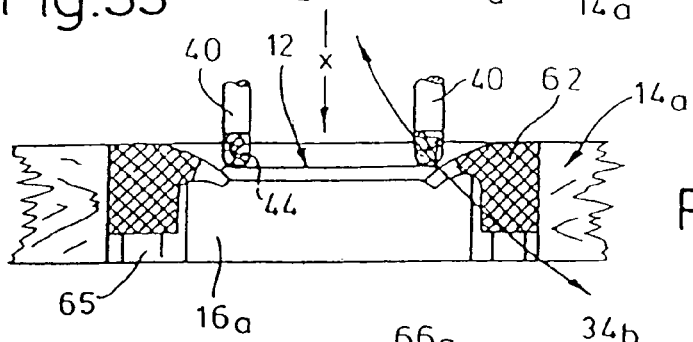

Referring to FIGS. 33 and 34, in an opening $\mathbf{16}_a$ of the same cross-section throughout, the female die $\mathbf{14}_a$ shown therein receives on both sides a shaped support portion 62 which is clearly illustrated in FIG. 32 and which comprises a cylindrical inversion-action neck 63 and a radial support lip 64 which in turn has an edge opening 32. The inversion-action neck 63 is connected to a plug-in profile member 65.

The waste portion 12 which lies on the mutually facing support lips 64 is urged in the breaking-out direction against the support lips 64 by pin-like breaking-out tools 40 which are provided above the support lips 64. In that case, the support lips 64 are elastically deformed and, when relieved of load, move quickly back into the initial position. In this case also, the breaking-out tools 40 are arranged in the region of the edge openings 32.

Figure 35:
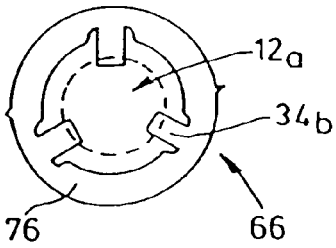
Figure 36:
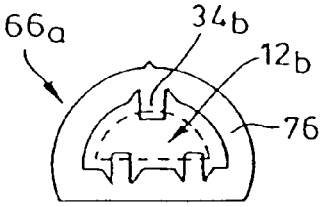
Figure 37:
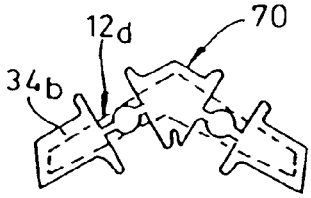
Figure 38:
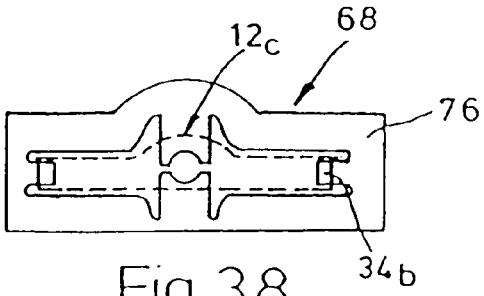
Figure 39:
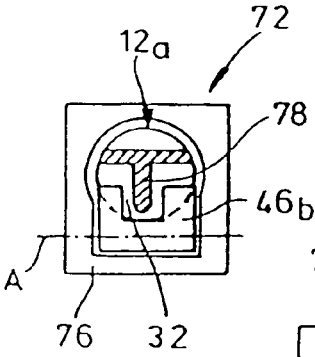
FIGS. 39 and 40 show plan views of special tools having a mechanical action.
Figure 40:
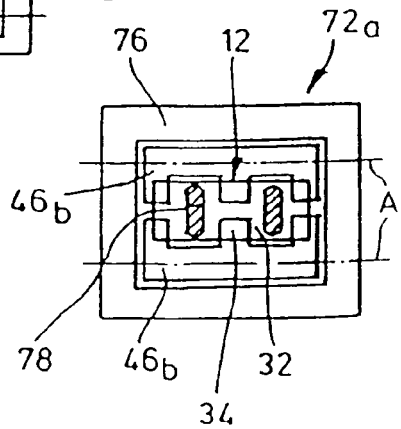

The drawing shows in plan hereinafter some diagrammatic views of special tools, more specifically FIGS. 35 and 36 showing spring clips 66, $\mathbf{66}_a$ for waste portions $\mathbf{12}_a$ and $\mathbf{12}_b$ respectively of round and half-round contour, while in addition FIGS. 37 and 38 show spring clips 70 and 68 for waste $\mathbf{12}_c$ of an extended so-called Euro-hole or for cigarette waste $\mathbf{12}_d$. FIGS. 39 and 40 show mechanical clips 72 and $\mathbf{72}_a$ respectively for round waste portions $\mathbf{12}_a$ and for rectangular waste portions 12.

These special tools 66, $\mathbf{66}_a$, 68, 70, 72, $\mathbf{72}_a$ —which are suitable as a basis for standardisation—each have a frame portion 76 from which project spring tongues $\mathbf{34}_a$ which are directed inwardly in FIGS. 35 through 37. The rectangular frame portions 76 of the clips 72, 74 in FIGS. 39, 40 include support plates $\mathbf{46}_b$ which are possibly of a resilient nature and which are limitedly rotatable about a respective pivot axis A and into whose edge opening or openings 32 projects a respective pressure profile member 78.

FIG. 41 shows a support tool $\mathbf{20}_e$ whose vertical limb 22 which is of rectangular cross-section is provided with a strip 80 which is parallel thereto at a spacing y, forming a channel; the two are connected by a transverse web portion 82 which is formed thereon at both sides.

The parallel strip 80 engages from below into a stamped-out opening 84, which is of a cross-section corresponding to the parallel strip 80, in the breaking-out board 14. The stamped-out opening 84 is separated from the opening 16 of rectangular cross-section, by a board web portion 86 which is disposed in the above-mentioned channel. A vertical groove $\mathbf{28}_a$—also of rectangular cross-section—extends from the opening 16, with stepped flank surfaces 88. The vertical limb 22 of the support tool $\mathbf{20}_f$ in FIGS. 43 through 45 is also carried in the back region 90 of a vertical groove $\mathbf{28}_a$. Plug-in strips 92 of L-shape in longitudinal section are formed at a spacing y, by virtue of the above-mentioned transverse web portions 82, on the flanks of the vertical limb 22. In the rest position shown in FIGS. 43 and 44, the strips 92 are fitted into corresponding flank holes 94 in the breaking-away board 14—the latter are therefore in alignment with the back region 90 of the vertical groove $\mathbf{28}_a$.

A support arrangement 96 in the breaking-away board 14 in FIGS. 46 and 47 comprises an angular plastic body 21 which is provided for the vertical groove $\mathbf{28}_b$, the plastic body having a short vertical limb 97 which has a downwardly open plug-in passage 92 for a plug-in tongue 99, of rectangular cross-section, of the vertical limb 100 of an angle bracket 102. Its limb 101 which is horizontal in FIGS. 46 and 47 is fixed in force-locking engagement to the underneath surface 13 of the breaking-out board 14.

What is claimed is:

1. Apparatus for removing broken-out pieces, from a sheet of material which contains blanks and which rests on a female die in such a way that a broken-out portion extends over an opening in a breaking-out surface and is urged away through the opening under the pressure of at least one breaking-out tool, wherein associated with the breaking-out tool is a support means which is movable in a direction of movement of the breaking-out tool and which is rigidly connected in positively locking relationship to the breaking-out surface or female die in an edge region of the opening and which projects into the opening with a support surface which can be inclined with respect to a connection pairing and which in a rest position engages in substantially parallel relationship under the broken-out piece disposed in the sheet of material and which is adapted to be variable in its position upon the movement of the broken-out piece by the breaking-out tool, wherein the connection pairing for the support means comprises at least one undercut receiving groove on the one hand and a portion which can be fitted thereinto and which extends in the breaking-out direction (x) on the other hand, characterized in that a plurality of cross-sections of the receiving groove and a portion forming a first coupling rib or bar are of a dovetail-shaped configuration, wherein the support means appears in longitudinal section as an angle portion with at least one coupling rib which is formed out of one of a plurality of limbs for a receiving groove of the female die formed in a limb for a second coupling rib of the female die on the one hand and with a flexible limb forming the support surface on the other hand, wherein the flexible limb forming the support surface has an edge opening which is delimited on both sides by cantilever portions, and at least one inner opening at a spacing in relation to the edge opening.

2. Apparatus as set forth in claim 1, characterized in that arranged downstream, in the breaking-out direction (x), of the limb (24) forming the support surface (25) is at least one catch finger (38).

3. Apparatus as set forth in claim 2, characterized in that the at least one catch finger (38) is enlarged in longitudinal section from its free end (36) towards the limb (22) formed thereon.

4. Apparatus as set forth in claim 1, characterized in that the limb (24) forming the support surface (25) is flanked by side portions which are formed on the other limb (22) and form a pair of catch fingers (38).

5. Apparatus as set forth in claim 1, characterized in that the support tool ($20_a$) has a partial frame which is substantially U-shaped in cross-section and which comprises a back portion including the coupling rib or ribs (27), with two parallel side walls (23), wherein a support plate (46, $46_a$) is arranged pivotably about an axis (A) between the side walls.

6. Apparatus as set forth in claim 1, characterized in that said at least one breaking-out tool extends between a plurality of surfaces of the support means, said plurality of surfaces being movable in the breaking-out direction (x).

7. Apparatus as set forth in claim 1, characterized in that the portion including the support surface is provided at a free edge with at least one edge opening, wherein said at least one edge opening is disposed in opposite relationship to a free end of the breaking-out tool.

8. Apparatus as set forth in claim 1, characterized in that disposed opposite the support surface as a breaking-out tool is a pressure pin with a rounded free end which is in the form of a rough surface.

9. Apparatus as set forth in claim 8, characterized in that the rough surface is formed by a coating (44) selected from the group consisting of oxides, carbides, and corundum.

10. Apparatus as set forth in claim 8, characterized in that the coating (44) is applied by means of thermal spraying.

11. Apparatus as set forth in claim 8, characterized in that the rough surface is formed by a coating of plastic material or rubber.

12. Apparatus as set forth in claim 8, characterized in that the rough surface is formed by irregularities provided in the surface of the pressure pin (40) or the fork prongs (42, $42_a$, $42_b$), wherein the surface of the pressure pin or the fork prongs (42) is roughened mechanically, chemically or electrically.

13. Apparatus as set forth in claim 1, characterized in that associated with the support surface as a breaking-out tool is a fork member with one or more finger-like fork prongs.

14. Apparatus as set forth in claim 13, characterized in that the free end of the fork prongs is formed by a part-circular curve (43$_a$ in FIGS. 18, 23) formed therein or a tip (FIGS. 30, 31) formed out thereon.

15. Apparatus as set forth in claim 13, characterized in that an axial height (h) of a rough surface corresponds at most to a diameter (d) of the pressure pin or a width of the fork prong.

16. Apparatus as set forth in claim 13, characterized in that the fork member projects from a plate-shaped male die, wherein the portion of the fork member, which is connected to the male die, has clamping noses.

17. Apparatus as set forth in claim 1, characterized by a clip-like tool (68 through 74) which is fixed to the opening (16, 16$_a$) and which respectively includes a frame portion (76) from which resilient support tongues (34$_b$) project inwardly or on which at least one inwardly disposed support plate (46$_b$) is arranged movably about a pivot axis (A).

18. Apparatus as set forth in claim 17, characterized by a frame portion (76) which is at least partially curved in plan view or by a substantially rectangular frame portion (76).

19. Apparatus as set forth in claim 1, wherein said one or more finger-like fork prongs comprise a flat cross-section.

* * * * *